US006634548B1

(12) United States Patent
Bowman

(10) Patent No.: US 6,634,548 B1
(45) Date of Patent: Oct. 21, 2003

(54) TENNIS PAL

(76) Inventor: Robert D. Bowman, 727 Mariner Cir., Webster, NY (US) 14580

( * ) Notice: Subject to any disclaimer, the term of this patent is extended or adjusted under 35 U.S.C. 154(b) by 267 days.

(21) Appl. No.: 09/813,725

(22) Filed: Mar. 21, 2001

Related U.S. Application Data

(60) Provisional application No. 60/197,696, filed on Apr. 18, 2000.

(51) Int. Cl.[7] ..... G07G 1/00
(52) U.S. Cl. ..... 235/1 B
(58) Field of Search ..... 235/1 B; 377/5; 700/91, 92; 473/553, 62; 2/160, 161.1, 162, 161.4

(56) References Cited

U.S. PATENT DOCUMENTS 3,777,699 A * 12/1973 Pfleger ..... 116/223
3,936,963 A 2/1976 Chan
3,942,525 A * 3/1976 Dragan ..... 602/60
4,128,893 A * 12/1978 Johnson et al. ..... 700/91
4,220,992 A * 9/1980 Blood et al. ..... 700/91
4,331,098 A * 5/1982 Rubano ..... 116/225
4,362,401 A * 12/1982 Mitamura et al. ..... 368/309
5,134,565 A * 7/1992 Herbertz ..... 340/323 R
5,513,391 A * 5/1996 Garneau et al. ..... 2/161.1
5,564,702 A * 10/1996 Meffert ..... 273/153 R
5,697,103 A * 12/1997 Wiggins ..... 2/159
5,819,313 A * 10/1998 McCrane ..... 2/16
5,820,000 A * 10/1998 Timberlake et al. ..... 224/219
6,210,296 B1 * 4/2001 Gabriel ..... 473/464

* cited by examiner

*Primary Examiner*—Karl D. Frech
*Assistant Examiner*—Edwyn Labaze
(74) *Attorney, Agent, or Firm*—Howard J. Greenwald

(57) ABSTRACT

A portable tennis scoring device having a flexible strap removably attached to a casing. The casing preferably contains a circuit chip and a battery; and the circuit chip is activated one or more of four activation switches, which cause information to be displayed ("activates") in one or more of four separate displays. Additionally, two additional activation switches are used to either turn the unit on, turn the unit off, and/or reset one or more of the displays.

15 Claims, 5 Drawing Sheets

TENNIS PAL

CROSS-REFERENCE TO RELATED PATENT APPLICATION

This patent application claims priority based upon applicant's provisional patent application No. 60/197,696; filed Apr. 18, 2000

FIELD OF THE INVENTION

A portable device for keeping score of a tennis game and set which can be worn upon a user's wrist.

BACKGROUND OF THE INVENTION

U.S. Pat. No. 3,936,963 of Kinglsey Chan discloses a mechanical wrist-worn tennis scoring device which contains five rotatable disks which are mechanically rotated during a tennis match to record the score. With this device, a series of buttons must be pressed, and dials must be moved, to change the display on the face of the device.

The device of the Chan patent is rather cumbersome and time-consuming to use, especially with a fast-paced tennis game. When one is a participant in a tennis game, it often is not feasible to suspend play for inordinate amounts of time to change the display of such device.

It is an object of this invention to provide a wrist-worn tennis scoring device which is more efficient, more accessible, and provides more functionality than the device of the Chan patent.

SUMMARY OF THE INVENTION

In accordance with this invention, there is provided a wrist-worn tennis scoring device comprised of an adjustable, flexible strap comprised of a hook and loop fastening surface, and a casing comprising electrical circuitry, four distinct displays, and six buttons for actuating and/or changing such displays.

BRIEF DESCRIPTION OF THE DRAWINGS

The tennis scoring device of this invention will be described by reference to the specification and to the enclosed drawings, in which like numerals refer to like elements, and in which.

DESCRIPTION OF THE PREFERRED EMBODIMENTS

Figure 1:
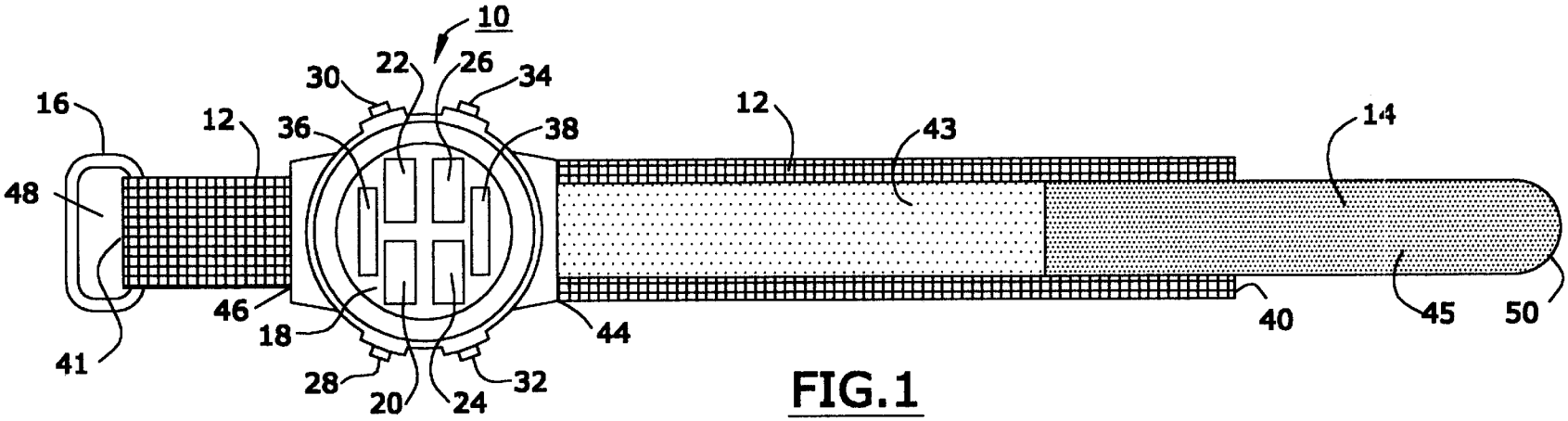
FIG. 1 is a top view of one preferred tennis scoring device of this invention.

FIG. 1 a top view of one preferred tennis scoring device 10. Referring to FIG. 1, it will be seen that device 10 is comprised of a strap 12, a flexible tongue 14 attached to strap 12, means 16 for removably attaching tongue 14 to strap 12, and electronic display device 18. The electronic display device 18 is comprised of displays 20, 22, 24, and 26, and buttons 28, 30, 32, 34, 36, and 38.

In the preferred embodiment depicted in FIG. 1, the strap 12 is preferably continuous, extending from point 40 to point 41 and being removably attached to the sides 44 and 46 of display device 18 by conventional means. In the preferred embodiment depicted in FIG. 1, the strap 12 is disposed between a pin (not shown) removably connected to side 44 and side 44, and thence it is disposed between a pin (not shown) removably connected to side 46 and side 46. As will be apparent to those skilled in the art, this attachment means is commonly used to attach a watch to a watch strap.

The strap 12 is preferably substantially impervious to moisture. In one embodiment, the strap 12 is made from nylon fabric which, preferably, has a high tensile strength.

Referring again to FIG. 1, and in the preferred embodiment depicted therein, it will be seen that strap 12 has, attached to the top surface 43 of one surface of one portion of such strap 12, a segment of "VELCRO" hook and loop fastening material. In the embodiment depicted, the hook material is disposed on top surface 43, and a corresponding loop material 45 is disposed on the top surface 47 of tongue 14.

As is known to those skilled in the art, "VELCRO" is a synthetic material sold in ribbon, sheet, or piece goods form, said material having complemental parts which adhere to each other when pressed together and adapted for use as a closure fastener. It contains separable fasteners, namely hook and loop type fasteners, and components thereof. See, e.g., U.S. Pat. Nos. 6,194,629, 6,193,885, 6,193,196, 6,193,118, 6,193,034, and the like; the entire disclosure of each of these United States patents is hereby incorporated by reference into this specification.

Referring again to FIG. 1, and in the preferred embodiment depicted, a separate tongue 14 is integrally connected to strap 12. In another embodiment, not shown, the tongue 14 is a part of strap 12, is integrally connected thereto, and is made from the same material.

In the embodiment depicted in FIG. 1, the tongue 14 comprises or consists essentially of elastomeric material, such as rubber or synthetic rubber. In the embodiment depicted, although tongue 14 is flexible, it preferably is more rigid than strap 12.

The portion of strap 12 which is connected to side 46 of display 18 is preferably connected to a loop 48 through which end 50 of tongue 14 may be inserted and pulled in order to tighten the assembly 10 around a user's wrist. Once the assembly 10 is so secured, the loop material 45 may be put into contact with the hook material 43 to removably secure the assembly 10 upon a user's wrist.

Figure 2:
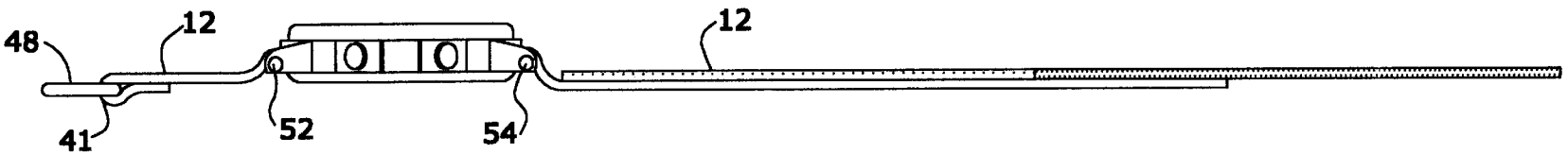
FIG. 2 is a side view of the tennis scoring device of FIG. 1.

FIG. 2 is a side view of the assembly 10, illustrating the pins 52 and 54 and the means by which the strap 12 is connected to such pins.

Figure 3:
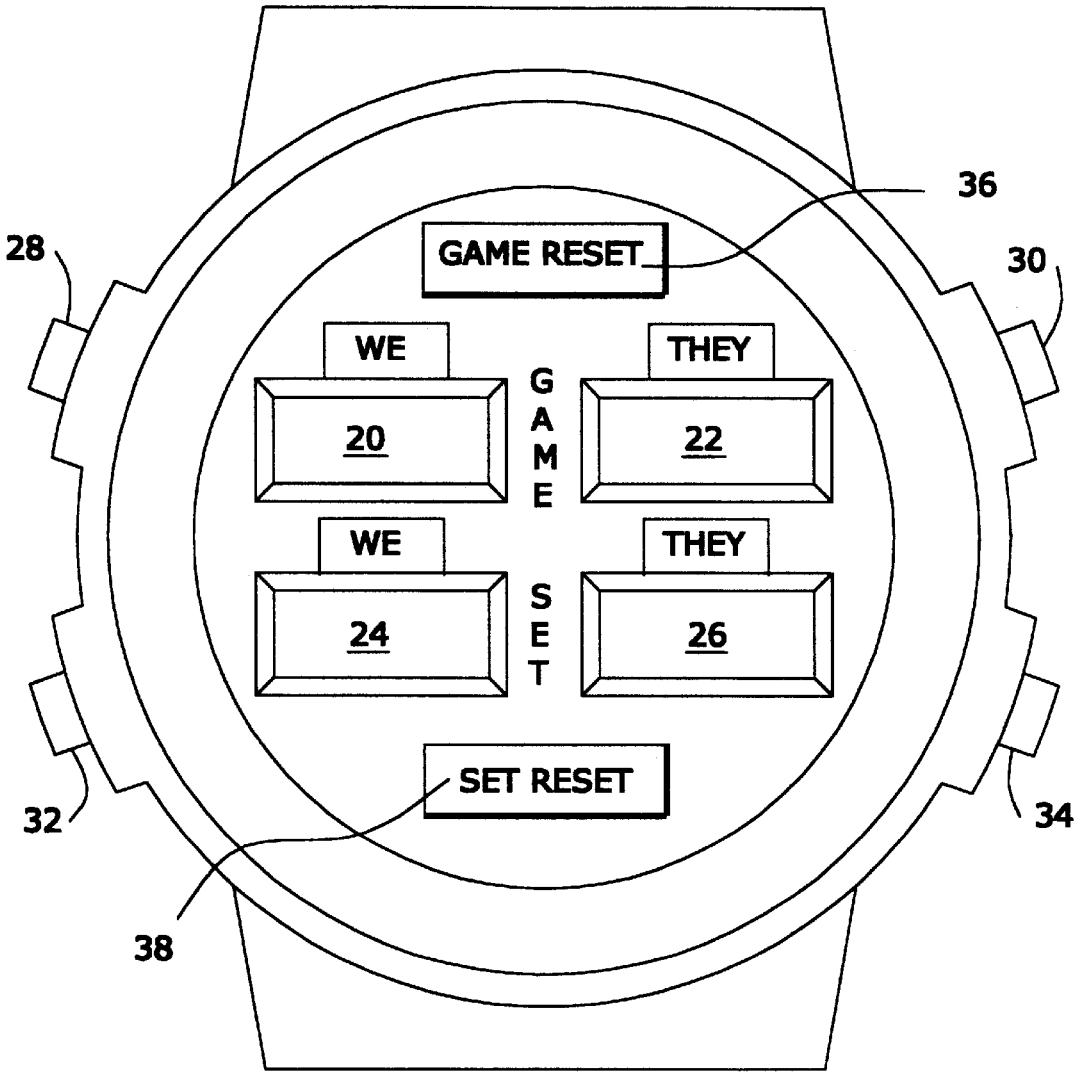
FIG. 3 is an enlarged top view of the display assembly of the device of FIG. 1.

FIG. 3 is a top view of the display 18 of FIG. 1. The display depicted in FIG. 3 operates in the manner described below.

The display 18 is comprised of a circuit chip (now shown) which controls the displays described below. As will be apparent to those skilled in the art, this circuit chip is designed to activate the functions described below when the activator buttons/switches are pressed by a user; and the casing also comprises a battery (not shown) adapted to power the circuit chip and the displays.

The case is comprised of a removable back cover which allows one, once it is removed, access to the battery compartment in order to replace the battery when it is spent.

The circuit chip used in the casing is preferably a fixed function chip whose functions are programmed into it to effectuate the steps described below.

There are six (6): Activator buttons. Activator buttons 28 and 30 advance/activate the score for each singles or doubles play. Activator buttons 32 and 34 advance/activate the games won for each singles or doubles play. Activator button 36 resets the score displays (20 and 22) to zero (0) to start a new game count or correct the recorded game score of the specific game. Activator button 38 resets the games displays (24 and 26) to zero (0) to start a new set count or correct the recorded set score for the specific set.

There are four (4) displays. Display 20 displays the "WE" players single or doubles individual game score. The 20 display shows consecutively the following: 0, 15, 30, 40, DU (Deuce), and AI (add-in). Display 22 displays the "THEY" players single or doubles individual game score. The 22 display shows consecutively the following: 0, 15, 30, 40, DU (Deuce), and AO (add-out). Display 24 displays the "WE" player sets score. The 24 display shows consecutively the following: 0,1,2,3,4,5,6,7,8, and 9. Display 26 displays the "They" player sets score. The 26 display shows consecutively the following: 0,1,2,3,4,5,6,7,8, and 9.

The game score is now described. The Score window(s) (20 and 22) for We or They display the following consecutive scores: 0, 15, 30, 40, DU (Deuce), and AI (add-in)- AO (add-out) Respectively. Each score is advanced by a single advance/click of the 28 score button or 30 score button respectively. If both 20 and 22 scores windows display as score of 40, a single advance/click of either the 28 or 30 score button will advance the score to Deuce (DU) for both score windows (20 and 22).

If Deuce (DU) is registered in both 20 and 22 scores displays and 28 is advanced/clicked, the score in 20 and 22 will read Add-In (AI).

If Deuce (DU) in registered in both score displays and 30 score button is advanced/clicked the score in 20 and 22 will read Add-Out (AO). If Al is registered in both 20 and 22 score displays and the 28 score button is advanced/clicked the 20 and 22 score display will be reset to zero (0) and the 24 window will be incremented by a +1.

If AI is registered in both 20 and 22 score displays and the 30 score button is advanced/clicked the 20 and 22 score display will both be set to display DU (Deuce).

If AO is registered in both 20 and 22 score displays and the 30 score button is advanced/clicked the 20 and 22 score display will be reset to zero (0) 26 window will be incremented by a +1.

If AO is registered in both 20 and 22 score displays and the 28 score button is advanced/clicked the 20 and 22 score display will both be set to display DU (Deuce) To correct a score on either 20 or 22 score displays the score reset button (36) advance/click will reset both the 28 and 20 score displays to zero (0). Then advance 28 and 30 score button appropriately until the correct score is reflected in the respective 20 and 22 score window.

Referring again to FIG. 3, the set score features will be described below.

Display 24 displays the number of "WE" players single or doubles Sets won. Display 26 displays the number of "THEY" players single or doubles Sets won. The display information in the 24 and 4B game window are: 0,1,2,3,4, 5,6,7, 8 and 9 consecutively. Set scores are recorded and incremented by either an automatic link to the 20 and 22 Score reaching one beyond AI or AO respectively or by a single advance/click of the 32 or 34 game count activation button respectively.

The Set Reset button 38 is used to clear both Set score windows (24 and 26) and set them to zero (0).

To correct a Set count display in either 24 or 26 game tally counter windows, advance/click the game reset button (38) which will reset both Set counter windows (24 and 26) to zero (0) then advance Set count activation button 32 and 34 appropriately until the correct Set score is reflected in the respective game Set Score window.

Figure 4A:
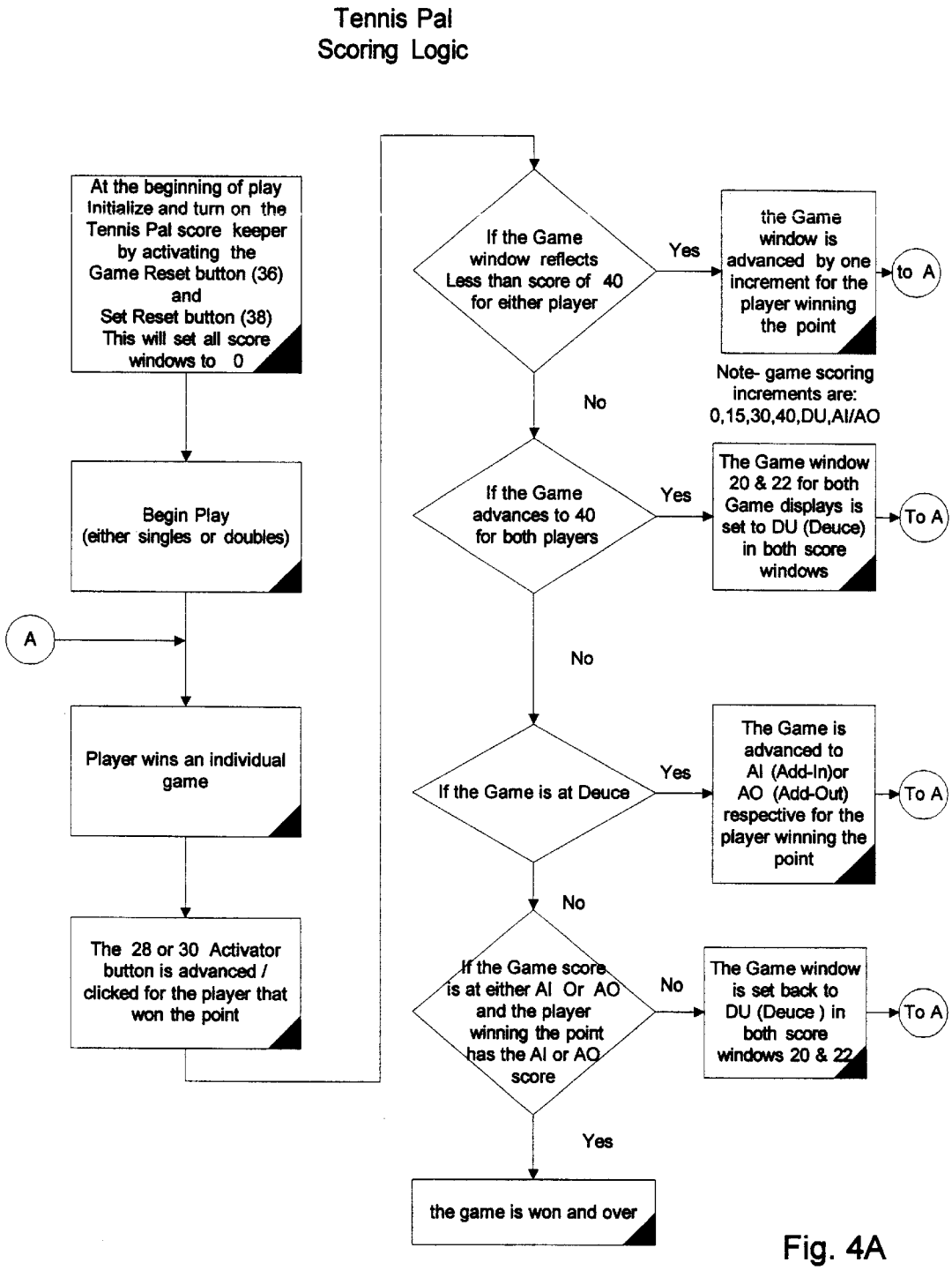
FIGS. 4A, 4B, and 4C each is a flow chart of the preferred display scoring logic used in the device of FIG. 1.
Figure 4B:
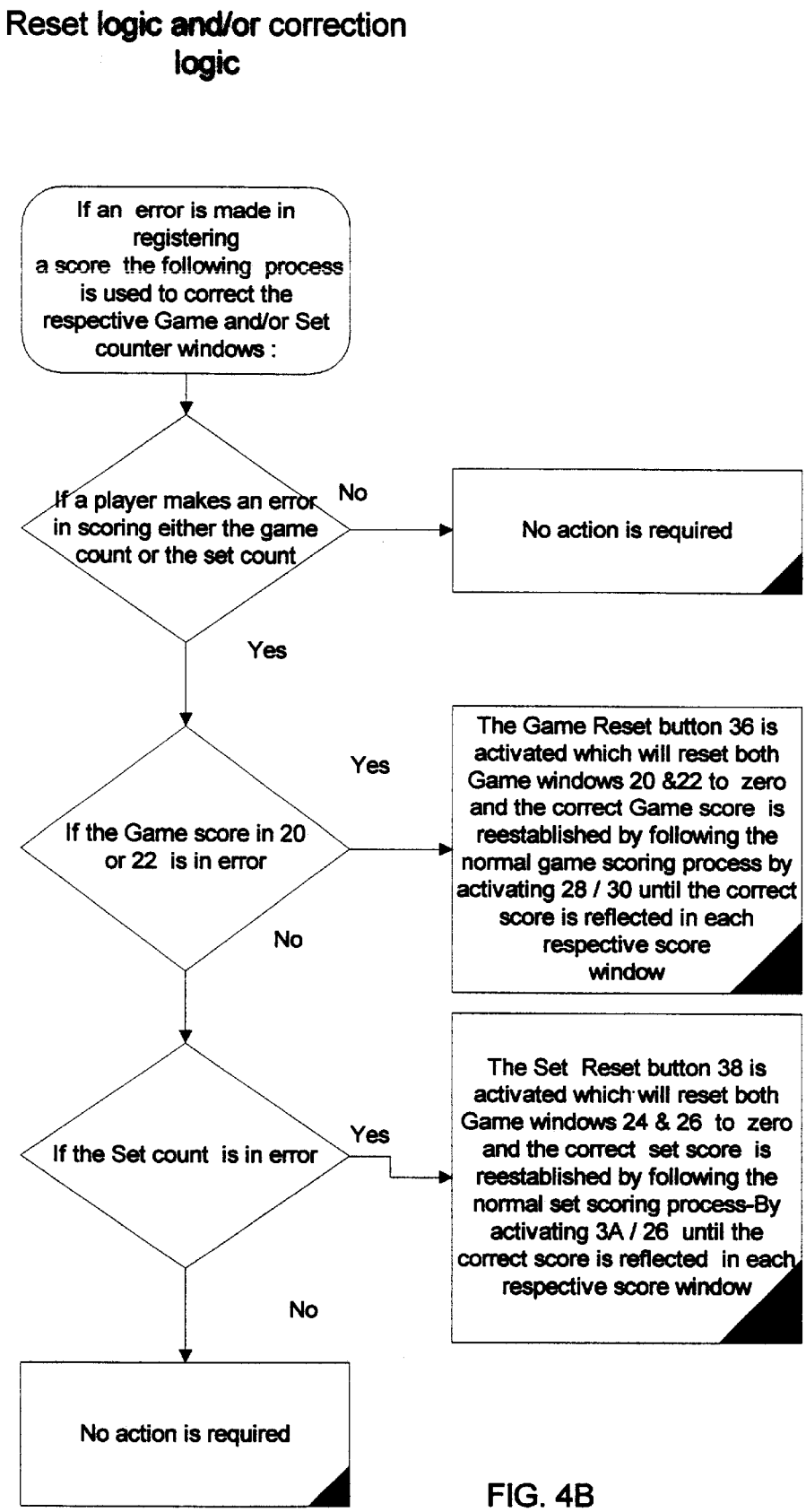
Figure 4C:
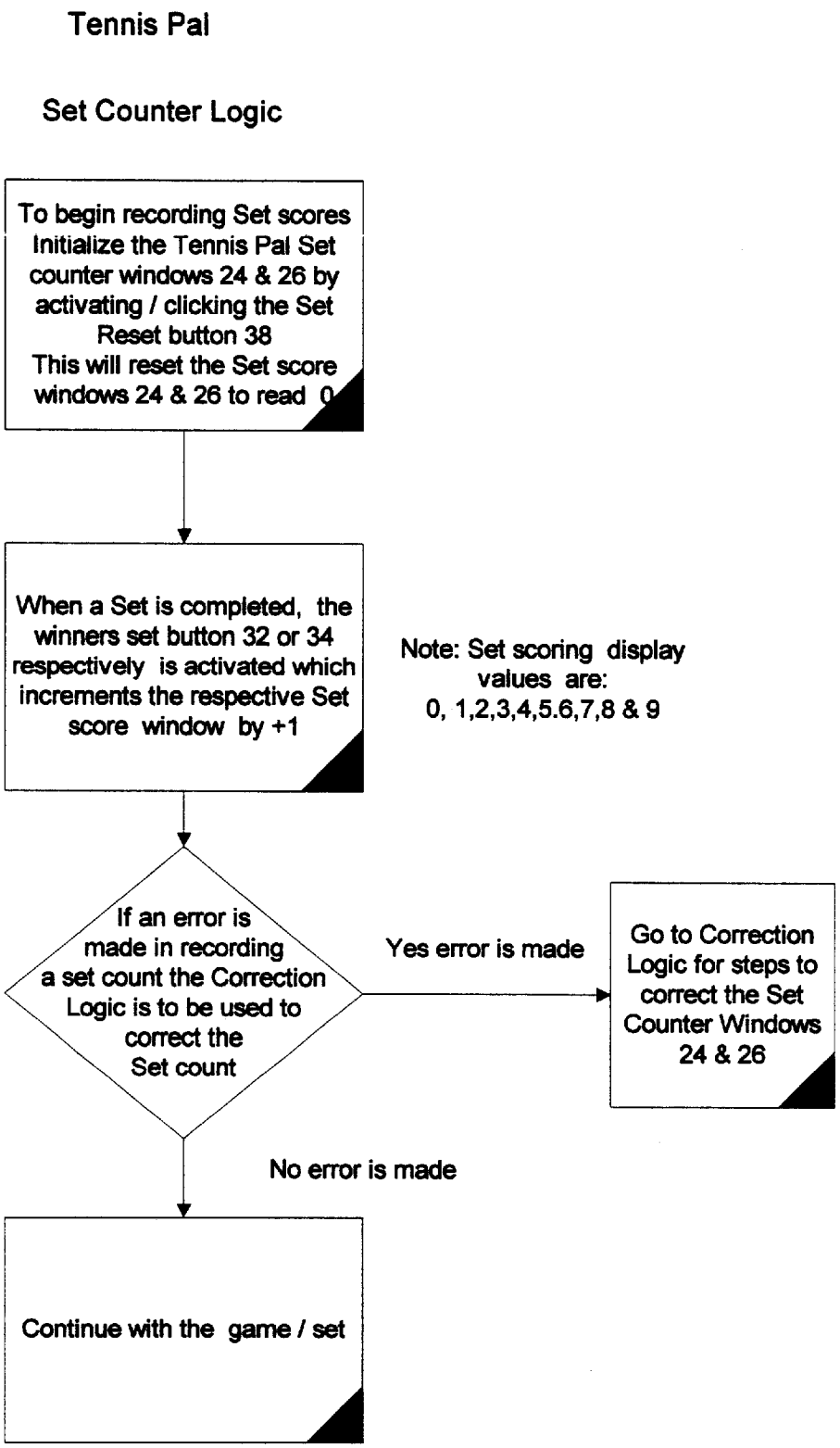

The aforementioned logic is described in the flow diagrams presented in FIGS. 4A and 4B.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A portable tennis scoring device comprising a flexible strap removably attached to a casing with a top surface and a bottom surface, means for attaching said flexible strap to said casing, means for removably attaching said casing to the wrist of a person, and display means disposed on said top surface of said casing, wherein:

(a) said flexible strap is comprised of a top surface, and a first separable fabric fastener material is disposed on said top surface of said flexible strap, (b) said means for removably attaching said casing to the wrist of a person comprises a second separable fabric fastener material adapted to removably engage with said first separable fabric fastener material, (c) said casing is comprised of an electronic device comprising a first activation switch, a second activation switch, a third activation switch, a fourth activation switch, a fifth activation switch, and a sixth activation switch, wherein:

1. said first activation switch activates a first display, said second activation switch activates a second display, said third activation switch activates a third display, and said fourth activation switch activates a fourth display,
2. said fifth activation switch resets said first display and said second display to a zero value,
3. said sixth activation switch resets said third display and said fourth display to a zero value,
4. said fifth activation switch turns power on to said electronic device, and
5. when both of said fifth and sixth activation switches are pressed simultaneously, the power to said electronic device is turned off.

2. The portable tennis scoring device as recited in claim 1, wherein said strap is connected to a flexible tongue.

3. The portable tennis scoring device as recited in claim 2, wherein said flexible tongue is comprised of a top surface and a bottom surface.

4. The portable tennis scoring device as recited in claim 3, wherein said second separable fabric fastener material is disposed on said top surface of said tongue.

5. The portable tennis scoring device as recited in claim 4, wherein said tongue is comprised of elastomeric material.

6. The portable tennis scoring device as recited in claim 5, wherein said strap is comprised of a proximal end and a distal end.

7. The portable tennis scoring device as recited in claim 6, wherein said tongue is connected to said distal end of said strap.

8. The portable tennis scoring device as recited in claim 7, wherein a loop is connected to said proximal end of said strap.

9. The portable tennis scoring device as recited in claim 8, wherein said means for removably attaching said flexible strap to said casing is comprised of a first pin and a second pin, each of which is removably attached to said casing.

10. The portable tennis scoring device as recited in claim 9, wherein said device is comprised of a battery.

11. The portable tennis scoring device as recited in claim 10, wherein said casing is comprised of a removable back cover.

12. The portable tennis scoring device as recited in claim 1, further comprising means for displaying a first value in said third display, wherein said first value is selected from the group consisting of 0, 1, 2, 3, 4, 5, 6, 7, 8, and 9.

13. The portable tennis scoring device as recited in claim 12, further comprising means for displaying a second value in said fourth display, wherein said second value is selected from the group consisting of 0, 1, 2, 3, 4, 5, 6, 7, 8, and 9.

14. The portal tennis scoring device as recited in claim 13, further comprising means that, when said first activation switch is pressed, said means causes a third value shown in said first display to change from said third value to a fourth value, wherein said third value and said fourth value are selected from the group consisting of 0, 15, 30, 40, DU, AO, and AI.

15. The portal tennis scoring device as recited in claim 14, further comprising means that, when said second activation switch is pressed, said means causes a fifth value shown in said second display to change from said fifth value to a sixth value, wherein said fifth value and said sixth value are selected from the group consisting of 0, 15, 30, 40, DU, AO, and AI.

* * * * *